United States Patent [19]

Cline

[11] 4,420,112

[45] Dec. 13, 1983

[54] PORTFOLIO CONSTRUCTION

[76] Inventor: Robert C. Cline, Washburn Terrace, Saugerties, N.Y. 12477

[21] Appl. No.: 260,592

[22] Filed: May 6, 1981

Related U.S. Application Data

[63] Continuation of Ser. No. 59,320, Jul. 20, 1979, abandoned.

[51] Int. Cl.[3] ..... B65D 27/08

[52] U.S. Cl. ..... 229/72; 150/39; 206/215; 281/31

[58] Field of Search ..... 229/1, 5 R, 72; 150/39; 269/215; 281/15 B, 31

[56] References Cited

U.S. PATENT DOCUMENTS

| | | | |
|---|---|---|---|
| 91,728 | 6/1869 | Eastman | 229/72 |
| 2,306,215 | 10/1942 | Freifeld | 229/72 |
| 3,129,872 | 4/1964 | Lutwack | 229/72 |
| 3,227,471 | 1/1966 | Coniker | 150/39 |
| 3,537,728 | 11/1970 | Reese | 281/31 |
| 3,826,360 | 7/1974 | Shore | 229/72 |
| 3,870,223 | 3/1975 | Uryant | 229/72 |
| 4,051,996 | 10/1977 | Ross | 229/72 |

*Primary Examiner*—Herbert F. Ross

*Attorney, Agent, or Firm*—Hopgood, Calimafde, Kalil, Blaustein & Judlowe

[57] ABSTRACT

This portfolio construction can be made from a single sheet of light cardboard and it provides two covers hinged together and with each cover made with three layers of cardboard folded back on itself. Each cover has two pockets suitable for holding loose sheets. The inside panel of the back cover has a transverse slot into which the cardboard on the back of a writing pad can be inserted to retain and protect pad sheets when enclosed between the front and back covers of the portfolio; the pad sheets are exposed for ready writing when the portfolio covers are hinged open The only adhesive required is along one horizontal edge of each cover.

10 Claims, 7 Drawing Figures

-22-

PORTFOLIO CONSTRUCTION

This is a continuation of application Ser. No. 59,320, filed July 20, 1979, now abandoned.

PRIOR ART

Prior art known to the inventor is U.S. Pat. No. 3,870,223 issued Mar. 11, 1975.

BACKGROUND AND SUMMARY OF THE INVENTION

Advantageous features of the portfolio are to have the portfolio as flat as possible when empty; and to have a number of different pockets so that there can be some classification of papers or pictures placed in the portfolio. It is an outstanding feature if the construction can be made by folding single sheets of light cardboard with a minimum amount of adhesive connections since these features reduce the cost of manufacture and make the product less expensive for the purchaser.

This portfolio is constructed so that it can be made of a single sheet of material with a vertical fold to provide back and front covers connected by the fold which serves as a hinge. Other folds, which are horizontal, provided four pockets with adhesive along only one bottom fold at the edge of each cover.

Slots are preferably cut along inner plies of the hinge fold to obtain greater flexibility of the hinge line of the portfolio; and the construction is such that all cutouts from a single sheet can be made when the sheet of material is flat and before any folds have been made.

Other objects, features and advantages of the invention will appear or be pointed out as the description proceeds.

BRIEF DESCRIPTION OF DRAWING

In the drawing, forming a part hereof, in which like reference characters indicate corresponding parts in all of the views.

DESCRIPTION OF PREFERRED EMBODIMENT

Figures 1, 1A, 2, 3, 4, 5, 6:
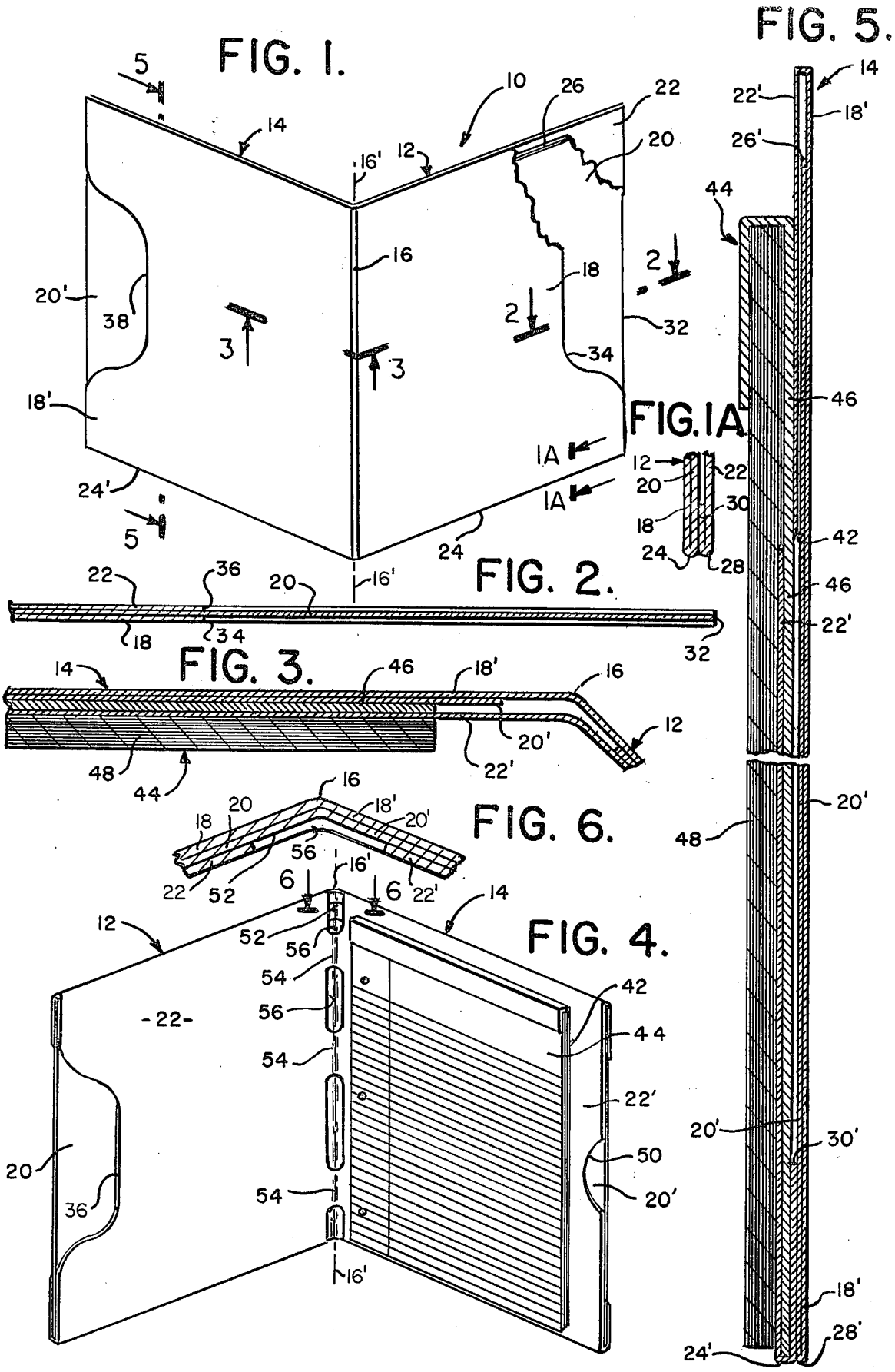
FIG. 1 is a partly broken-away isometric view of the portfolio of this invention when viewed from the outside and with its front and back covers in a partly open condition.
FIG. 1A is an enlarged, fragmentary, sectional view taken on the line 1A—1A of FIG. 1.
FIG. 2 is a greatly enlarged fragmentary sectional view taken on line 2—2 of FIG. 1.
FIG. 3 is an enlarged fragmentary sectional view taken on line 3—3 of FIG. 1.
FIG. 4 is a view, similar to FIG. 1, but viewing the portfolio from the inside.
FIG. 5 is an enlarged, sectional view taken on the line 5—5 of FIG. 1, the vertically central region being omitted so that upper and lower end regions can be better displayed.
FIG. 6 is a greatly enlarged, fragmentary, sectional view taken on the line 6—6 of FIG. 4.

A portfolio 10 has a front cover 12 and a back cover 14 which are of one-piece construction and folded along a hinge line 16, on a vertical axis 16'. Each cover has three panels. In the case of the front cover 12, there is an outer panel 18, a middle panel 20 and an inner panel 22. The outer panel and the inner panel 22 meet in a fold at the top of the front cover 12.

At top of the front cover 12, the outer panel 18 joins the middle panel 20, at a fold 24; and the middle panel 20 extends upward to a free edge 26 (FIG. 1).

From its connection with the outer panel 18, at the top of cover 12, the inner panel 22 extends downward to a bottom-edge fold 28 (FIG. 1A) thereby it connects with a tab 30 which extends across almost the full horizontal width of the front cover, terminating short of the hinge 16. The tab 30 is adhesively secured to the confronting surface of the middle panel 20, and this is the only adhesive required for the front cover 12.

The middle panel 20 of the front cover extends all the way of the outer vertical edge 32 (FIGS. 1 and 2) of the cover 12. There are edge cutouts 34 and 36 along the middle portion of the outer panel 18 and of the inner panel 22, respectively (FIG. 2). The purpose of these cutouts is to permit the person using the portfolio to be able to get access to sheets of paper that may be inserted into front and inner pockets, respectively in front of and behind the middle panel 20. In FIG. 1, the cutout 34 in the front-cover panel 18 is broken away to more fully illustrate its relation to the middle panel 20 and the inner panel 22.

The construction of the back cover 14 is generally similar to that of the front cover 12 and corresponding panels are illustrated by the same reference characters with a prime appended.

There are two principal differences between the back cover 14 and the front cover 12. One of these is shown best in FIG. 5. There is a horizontal slot 42 in the inner panel 22' (FIG. 5), and a writing pad 44 having a cardboard panel 46 is located behind sheets of paper 48 which complete the pad 44. The pad 44 is connected to the back cover 14 by inserting the cardboard panel 46 through slot 42 so that the cardboard below the slot 42 is confined between the inner panel 22' and the structure behind the inner panel; the latter structure includes the middle panel 20' and upturned tab 30' which is joined to the middle panel 20' at a bottom-edge fold 28'.

The pad 44 is supported in the portfolio 10 by having the bottom edge of the cardboard panel 46 bear against the inside of the fold 24' which connects tabs 30' to inner panel 22', as shown in FIG. 5. The pad 44 is held against horizontal displacement by the ends of slot 42, which is only slightly longer than the width of the cardboard panel 46 at the back of pad 44.

The other feature of the back cover which differs from the front cover is that the inner panel 22' (FIG. 4) has a smaller cutout 50 since a cutout as large as either of the front-cover cutouts would extend behind the sheets of the pad 44 and would be of excessive size. On the other hand, there is no need for a small cutout at the outer panel 18' of the back cover 14, and therefore the edge cutout 38 in outer panel 18' may match those described at 34–36 of the front cover.

The middle panels 22 and 22' are held in place at their lower ends by their respective folds 24 and 24' (FIGS. 1A and 5); above their bottom edges panels 22 and 22' are held in place by their sandwich relation between outer panels 18 and 18' and inner panels 22 and 22'. In order to provide manufacturing tolerance in the manufacture of the portfolio, the middle panels 20 and 20' do not extend all the way into the upper-edge fold (at the top of the portfolio) where the outer panels 18 and 18'join the inner panels 22 and 22'. However, as a precaution against rough handling of the portfolio, a connection (FIGS. 4 and 6) can be provided between upper end of the middle panels to resist horizontal displcement of either of the middle panels. This connection 52 is optional, and the middle panels 20 and 20' do not have any other connection between their adjacent vertical edges, which are close to the hinge line 16.

There are preferably a number of axially-spaced hinge connections 54 between the inner panels 22 and 22' and the these hinge connections provide extra strength without interfering with the neat folding of the portfolio along the hinge line 16, being the fold line of outer panels 18 and 18', to each other. The inner-panel hinge connections also tend to prevent papers in the pockets of the portfolio from moving into positions where they cross the hinge line and where they otherewise might interfere with a neat closing of the portfolio.

FIG. 6 provides a detailed showing of connection 52 extending across the hinge line 16, in the context of the uppermost cutout 56, along the hinge line adjacent the upper hinge portion 54.

The described portfolio will be seen to provide inner and outer pockets in each of its hinge-connected front and back covers (12, 14), all from the same single piece of pliant sheet material. The covers have upper and lower edges, and hinge connection is on a fold axis which extends vertically between said edges. Each cover 12 (14) comprises an outer panel 18 (18') and a middle panel 20 (20') and an inner panel 22 (22'), the outer panels being connected to each other along the fold axis 16' of hinge connection 16. The middle panel 20 (20') of each cover is a first extension of the associated outer panel 18 (18') vertically beyond one of said upper and lower edges thereof and is folded along said one edge to lie in confronting outer-pocket-defining relation with the associated outer panels 18 (18'). The inner panel 22 (22') of each cover is a second and opposite extension of the associated outer panel vertically beyond the other of said upper and lower edges thereof and is folded along said other edge to lie in confronting inner-pocket-defining relation with the associated middle panel. Finally, securing means in the form of a bent tab 30 (30') at the outer vertically limiting otherwise-free edge of the associated inner panel adhesively fastens the inner and middle panels to each other essentially on an alignment adjacent and parallel to said one edge.

The preferred embodiment of the invention has been illustrated and described but changes and modifications can be made and some features can be used in different combinations without departing from the invention as defined in the claims. For example, the portfolio can be modified by having no cutouts 34 and 38 in the outer panels 18 and 18'. And edge cutouts can be made in the middle panels 20 and 20' to facilitate access to pocket spaces between the middle and outer panels, it being understood that such cutouts may be of sizes and at locations to provide most ready access to desired pockets.

What is claimed is:

1. A portfolio of one-piece pliant sheet construction, comprising front and back covers having spaced upper, lower and side edges, the covers being hinge-connected on a fold axis extending vertically between said upper and lower edges; each cover comprising an outer panel and a middle panel and an inner panel, the outer panels being connected to each other along the fold axis of hinge connection; the middle panel of each cover being a first extension of the associated outer panel vertically beyond one of said upper and lower edges thereof and folded along said one edge to lie in confronting outer-pocket-defining relation with the associated outer panel; the inner panel of each cover being a second and opposite extension of the associated outer panel vertically beyond the other of said upper and lower edges thereof and folded along said other edge to lie in confronting inner-pocket-defining relation with the associated middle panel; securing means fastening said inner and middle panels to each other essentially on an alignment adjacent and parallel to said one edge; and said side edges being unfastened to define pockets for the insertion of material between said outer, middle and inner panels.

2. A portfolio according to claim 1, in which said one edge is the lower edge.

3. A portfolio according to claim 1, in which said securing means is a folded tab extension of said inner panel, said tab being adhesively secured to said middle panel.

4. A portfolio according to claim 1, in which the inner panel of one of said covers has an elongate generally horizontal slit near its upper edge, whereby to insertably receive the cardboard panel of a pad of paper sheets tearably adhered at their upper edges to the upper-edge of said cardboard panel.

5. A portfolio according to claim 4, and including said pad, wherein the vertical offset of said slit from the lower edge of the associated inner panel is short of the top-to-bottom dimension of said cardboard panel, whereby the inserted cardboard panel receives bottoming support at the bottom connection of the associated inner and middle panels.

6. A portfolio according to claim 2, in which the upper edge of each of said middle panels extends substantially to the inside of the other-edge fold which connects the associated outer and inner panels.

7. A portfolio according to claim 6, in which said middle panels are connected directly to each other substantially only near their respective upper edges.

8. A portfolio according to claim 6, in which said inner panels are directly connected to each other at spaced locations substantially along the hinge axis.

9. A portfolio according to claim 8, in which said directly connected spaced locations are defined by and between spaced elongate slots in the otherwise continuous direct connection of said inner panels.

10. A portfolio according to claim 1, in which said securing means is the only means securing said construction.

* * * * *